US007540125B2

(12) United States Patent
Lindquist et al.

(10) Patent No.: US 7,540,125 B2
(45) Date of Patent: Jun. 2, 2009

(54) BURSTING APPARATUS AND METHOD

(75) Inventors: Rob W. Lindquist, De Pere, WI (US); Michael G. Boehm, De Pere, WI (US); Mathew L. Dean, Green Bay, WI (US)

(73) Assignee: Northfield Corporation, De Pere, WI (US)

( * ) Notice: Subject to any disclaimer, the term of this patent is extended or adjusted under 35 U.S.C. 154(b) by 4 days.

(21) Appl. No.: 11/691,033

(22) Filed: Mar. 26, 2007

(65) Prior Publication Data

US 2008/0236995 A1 Oct. 2, 2008

(51) Int. Cl.
*B65B 63/00* (2006.01)
*B65H 35/10* (2006.01)

(52) U.S. Cl. ..... 53/435; 53/520; 221/25; 225/4; 225/100

(58) Field of Classification Search ..... 53/435, 53/520; 221/25; 225/4, 100; *B65H 35/10*
See application file for complete search history.

(56) References Cited

U.S. PATENT DOCUMENTS 2,252,733 A * 8/1941 Sherman et al. ..... 225/4
2,513,093 A 6/1950 Hagman
2,618,336 A 11/1952 Davidson
2,655,842 A 10/1953 Baumgartner
2,970,784 A * 2/1961 Kessler ..... 225/100
3,127,027 A 3/1964 Roser et al.
3,128,928 A 4/1964 Davis
3,140,026 A 7/1964 Davis
3,146,927 A 9/1964 Peterson
3,182,876 A 5/1965 Sedor et al.
3,220,158 A 11/1965 Roser et al.
3,272,044 A 9/1966 Obenshain
3,281,143 A 10/1966 Mommsen et al.
3,302,946 A 2/1967 Anderson
3,332,324 A 7/1967 Lehmacher et al.
3,338,487 A 8/1967 Schultz
3,390,875 A 7/1968 Beert et al.
3,481,520 A 12/1969 Pickering
3,631,651 A 1/1972 Kopp
3,659,766 A 5/1972 Alago (Continued)

FOREIGN PATENT DOCUMENTS

CA 2013280 4/1994

(Continued)

*Primary Examiner*—Stephen F Gerrity
(74) *Attorney, Agent, or Firm*—Alan R. Stewart; Godfrey & Kahn, S.C.

(57) ABSTRACT

A method of operating an inserter with infeed and outfeed each driven by a separate servo motor. A controller independently energizes the servo motors to drive the infeed and outfeed to position a continuous feed of objects with a first object in the outfeed and a web between the first and second objects within a bursting space. The outfeed exerts tension on the continuous feed when the web is within the bursting gap. The web is burst and the first object is ejected from the outfeed into an item on a production line. An inserter with separate servo motors driving the infeed and the outfeed to position objects of a continuous feed, to burst webs between the objects by generating tension in the webs and to eject the burst objects from the inserter.

13 Claims, 8 Drawing Sheets

U.S. PATENT DOCUMENTS 3,672,551 A 6/1972 Peterson
3,675,542 A 7/1972 Torigoe
3,730,411 A 5/1973 Brockmuller
3,741,451 A 6/1973 Parenti et al.
3,748,937 A 7/1973 Long
3,777,958 A 12/1973 Graham
3,794,228 A 2/1974 Colwill et al.
3,797,822 A 3/1974 Anderson
3,847,318 A 11/1974 Parenti et al.
3,856,196 A 12/1974 Bayne et al.
3,863,821 A 2/1975 Van Bennekom
3,881,645 A 5/1975 Kopp
3,888,399 A 6/1975 Hanson et al.
3,894,669 A 7/1975 Wescoat
3,897,052 A 7/1975 Turman et al.
3,908,983 A 9/1975 Long
3,929,326 A 12/1975 Seragnoli
3,964,638 A 6/1976 Dimauro
3,968,196 A 7/1976 Wiley
3,987,603 A 10/1976 Jelling et al.
3,991,924 A 11/1976 Schueler
4,022,364 A 5/1977 Davis
4,025,023 A 5/1977 Moffitt
4,039,181 A 8/1977 Prewer
4,060,168 A 11/1977 Romagnoli
4,069,957 A 1/1978 Moffitt
4,091,978 A 5/1978 Graham, II
4,118,022 A 10/1978 Rayfield et al.
4,131,272 A 12/1978 Hartnig
4,145,035 A 3/1979 Moser
4,179,113 A 12/1979 Gallimore
4,182,222 A 1/1980 Stahl
4,216,952 A 8/1980 McInerny
4,217,744 A 8/1980 Mizutani
4,222,511 A 9/1980 Schueler
4,261,497 A 4/1981 Roetter et al.
4,268,344 A 5/1981 Jones
4,284,221 A 8/1981 Nagel et al.
4,323,230 A 4/1982 Rising
4,345,753 A 8/1982 Marshall
4,351,517 A 9/1982 Neal et al.
4,354,894 A 10/1982 Lewis et al.
4,375,289 A 3/1983 Schmall et al.
4,385,537 A 5/1983 Wolf
4,397,410 A 8/1983 Schueler
4,401,249 A 8/1983 Kadlecik et al.
4,412,631 A 11/1983 Haker
4,429,217 A 1/1984 Hill et al.
4,454,973 A 6/1984 Irvine
4,455,809 A 6/1984 Dallaserra
4,473,218 A 9/1984 Dudek
4,479,597 A 10/1984 Johnson et al.
4,498,894 A 2/1985 Kuckhermann
4,516,765 A 5/1985 Stocco et al.
4,524,557 A 6/1985 Silverman et al.
4,529,114 A 7/1985 Casper et al.
4,530,200 A 7/1985 Prewer
4,606,534 A 8/1986 Gombault
4,616,773 A 10/1986 Kerivan
4,623,081 A 11/1986 Hain et al.
4,651,983 A 3/1987 Long
4,658,564 A 4/1987 Bell, Jr. et al.
4,668,212 A 5/1987 Kotani
4,688,708 A 8/1987 Irvine et al.
4,696,145 A 9/1987 Schmidt et al.
4,717,043 A 1/1988 Groover et al.
4,825,622 A 5/1989 Nigg
4,929,226 A 5/1990 Focke et al.
4,982,337 A 1/1991 Burr et al.
4,997,119 A * 3/1991 Meschi ..... 225/100
4,999,974 A 3/1991 Kovacs et al.
5,058,873 A * 10/1991 Hewitt et al. ..... 270/52.13
5,079,901 A 1/1992 Kotsiopoulos
5,104,022 A 4/1992 Nakamura et al.
5,141,142 A * 8/1992 Ramsey ..... 225/4
5,239,809 A 8/1993 Long
5,297,711 A 3/1994 Kogan
5,377,474 A 1/1995 Kovacs et al.
5,427,294 A 6/1995 VandenHeuvel
5,549,233 A 8/1996 Clauser
5,588,280 A 12/1996 Kotsipoulos
5,640,891 A 6/1997 Hoffa
5,715,656 A 2/1998 Pearce
5,752,365 A * 5/1998 Johnson et al. ..... 53/435
5,784,861 A 7/1998 Kotsiopoulos
5,785,224 A 7/1998 Nowakowski
5,845,462 A 12/1998 Kuehl et al.
5,934,534 A * 8/1999 Schmidt et al. ..... 225/4
5,941,053 A 8/1999 Kotsiopoulos
5,966,906 A 10/1999 Kuehl et al.
6,082,079 A 7/2000 Kuehl et al.
6,206,262 B1 3/2001 Achelpohl et al.
6,257,475 B1 7/2001 Ishii et al.
6,722,108 B1 4/2004 Kotsiopoulos
7,032,774 B2 4/2006 Boehm et al.
2004/0211807 A1 * 10/2004 Kolbe et al. ..... 225/100

FOREIGN PATENT DOCUMENTS

EP 0472624 12/1994
JP 5-331067 12/1993
JP 5-338997 12/1993

* cited by examiner

BURSTING APPARATUS AND METHOD

TECHNICAL FIELD

The present disclosure relates generally to devices and methods of operation of devices for separating inserts and ejecting inserts at a point of delivery.

BACKGROUND

Often during the production and packaging of a product along an assembly line, it desired to place some small item, such as a coupon or other relatively small or thin objects, into or onto the product or packaging. Particularly where the assembly line for these products moves at fairly rapid pace, it may be difficult or very labor intensive to place the correct number and type of item into or onto the packages. Over time, different machines that are part of, or may be positioned adjacent to, the assembly line have been developed to more accurately and quickly insert items into the packaging. These machines have also made possible a reduction in the level of human resources involved in the insertion process.

Conventional devices for inserting items may often draw the items from a large roll, fanfold or other bulk package. The items to be inserted may be formed into a continuous roll or stream, with a breakable web between the items. The continuous roll or stream of items, besides facilitating the production of the items themselves, may permit more efficient loading and operation of the insertion device. As part of the insertion process, the device may engage the roll or stream, separate the endmost of the items from the roll or stream and inject that item into the package. To facilitate this separation, the breakable web may include perforations, thinned sections, or other weakened portions.

Once the web is broken between two inserts, it may be desirable to move the separated insert as quickly as possible to the package to enable the package to move as quickly as possible in the line of packages, and also to enable the next insert to be positioned for separation and insertion. At the same time, it may be desirable to handle the roll or stream of inserts as smoothly as possible, to avoid premature separation.

Conventional separation and insertion devices may not be able to operate the infeed and outfeed elements handling the roll or stream and the insertion, respectively, in isolation with each other. A conventional device may incorporate a motor coupled to the infeed and outfeed by a transmission or clutch assembly, to permit the acceleration and deceleration as needed for staging and inserting the items.

Improvements to conventional separation and insertion devices and methods of operating these devices are desired.

SUMMARY

The present invention relates generally to a method operating an inserter for placing objects into items moving along a production line. The inserter includes an infeed and an outfeed, each connected to and driven by a separate independent servo motor. A controller energizes the servo motors to drive the infeed and the outfeed to position a first object of a continuous feed into the outfeed with a web between the first and second objects within a bursting gap between the infeed and the outfeed. The outfeed tensions the continuous feed to burst the web between the first and second objects, thus creating a burst object, and then ejects the burst object from the inserter. The burst object may be ejected into a package or other item on a production line.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

Figure 1:
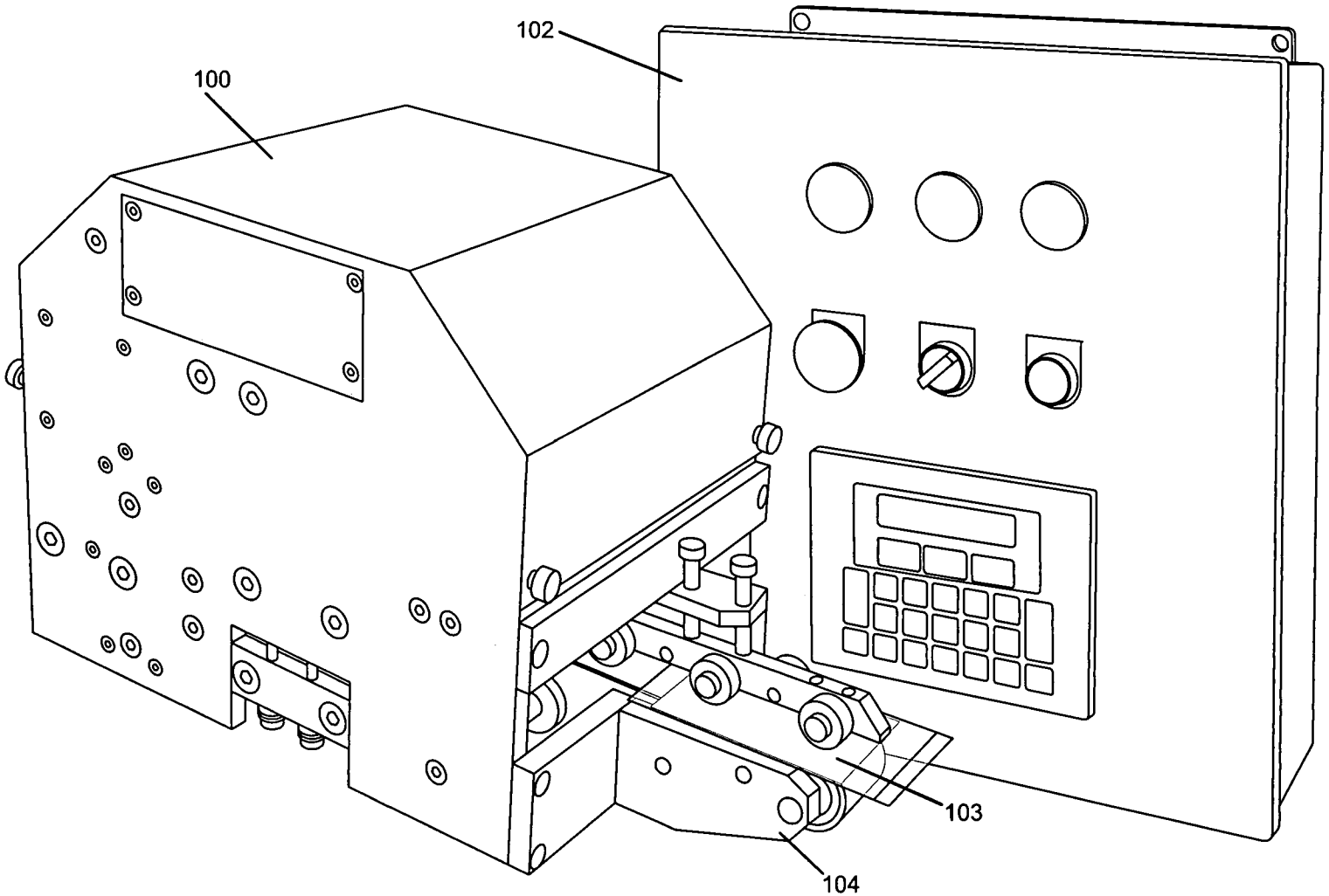
FIG. 1 is a perspective view of an insertion device according to the present disclosure including a controller.

FIG. 1 illustrates an inserter 100 with a controller 102. In a typical installation, inserter 100 would be mounted adjacent a production line of any suitable construction on which are moving items into which the insertion of an appropriate object is desired. The inserter 100 includes a nose 104, and the inserter 100 would be positioned so that objects such as a coupon 103 being handled by inserter 100 would be ejected from nose 104 into the items on the production line. Nose 104 may be altered as needed if it is necessary or desirable for inserter 100 to be mounted closer to or further away from the production line.

Controller 102 is operatively connected to inserter 100 and may be located directly adjacent the inserter or be remotely mounted if necessary or desired. Controller 102 provides the operational instructions to inserter 100 to regulate the nature and speed of operation of the inserter. Various controls, data entry interfaces and displays may be provided on an exterior of controller 102. Some or all of these controls, interfaces and displays may be mounted inside a housing of controller 102 if greater protection is desired. It is desirable that at least an emergency shut-off control is provided on an exterior surface of controller 102.

Nose 104 serves as an end of an outfeed 106 within inserter 100. Mounted within a housing of inserter 100 is an infeed 108, which can be seen in FIGS. 5 to 7, described in more detail below. Infeed 108 and outfeed 106 cooperate to define a path 110 through inserter 100 for objects being handled by the inserter to pass along. Infeed 108 pulls the objects into the inserter 100 and positions them for entry into outfeed 106.

Outfeed 106 directs the objects along the path 110 toward a point of delivery into the items on the production line.

Figure 3:
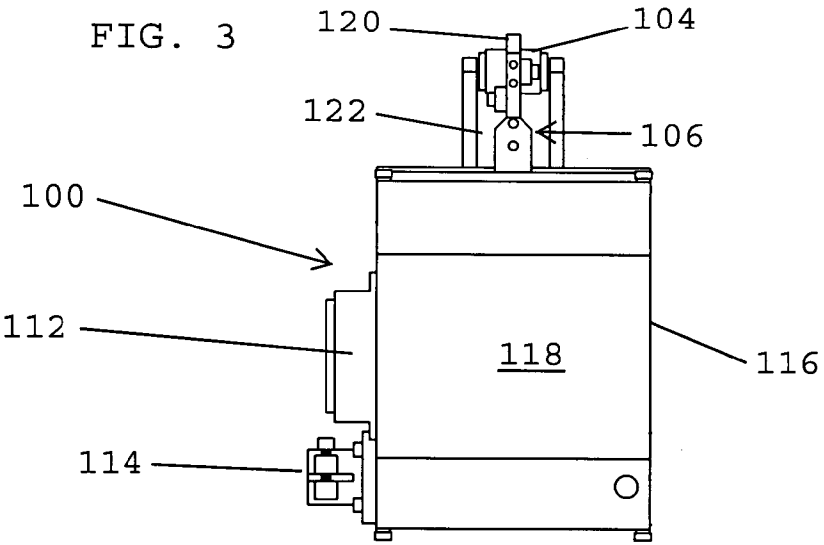
FIG. 3 is a top view of the insertion device of FIG. 1.
Figure 4:
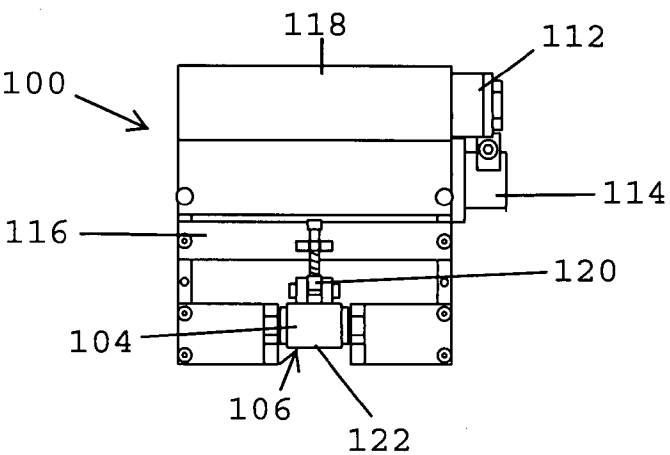
FIG. 4 is a front view of the insertion device of FIG. 1.
Figure 2:
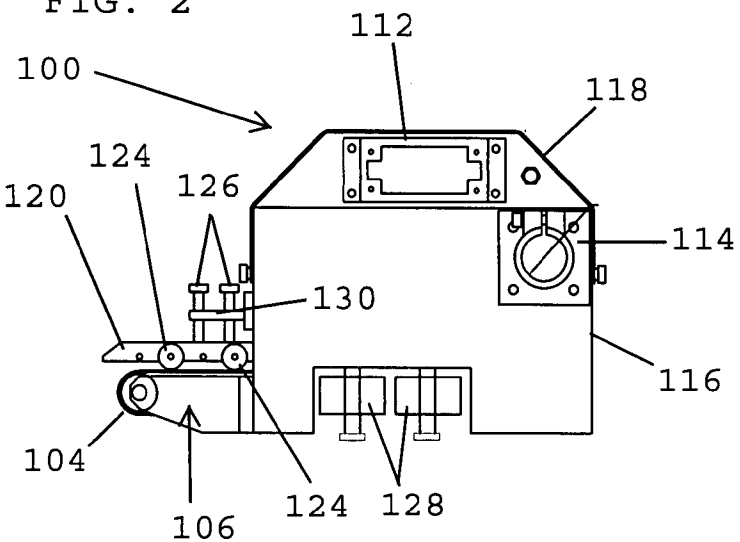
FIG. 2 is a side view of the insertion device of FIG. 1.

FIGS. 2 to 4 illustrate inserter 100 including a control cable port 112 and a pair of mounting brackets 114 mounted on either side of a housing 116. Housing 116 may include a removable cover 118 allowing access into an interior of housing 116. Outfeed 106 includes a lower driven belt 122 and an upper idler bar 120 which may include a plurality of tension rollers 124. Tension rollers 124 are configured to press the objects such as coupons 103 against belt 122 to ensure that the movement of belt 122 is transferred to the items in the path, by means of any suitable tensioning device. In the embodiment shown, a tensioning frame 127 is used to connect idler bar 120 to housing 116. One or more tensioning screws 126 may be used to set the appropriate or desired amount of tension exerted by rollers 124 against objects moving through the outfeed. Different thicknesses of objects moving through the outfeed may require that idler bar 120 be able to move as the objects pass along the belt. Tensioning screws 126 with spring biased return force against belt 122 provide the ability to permit sufficient vertical movement of idler bar 120 to permit objects to pass through the outfeed while still maintaining the desired tension against belt 122.

Figure 5:
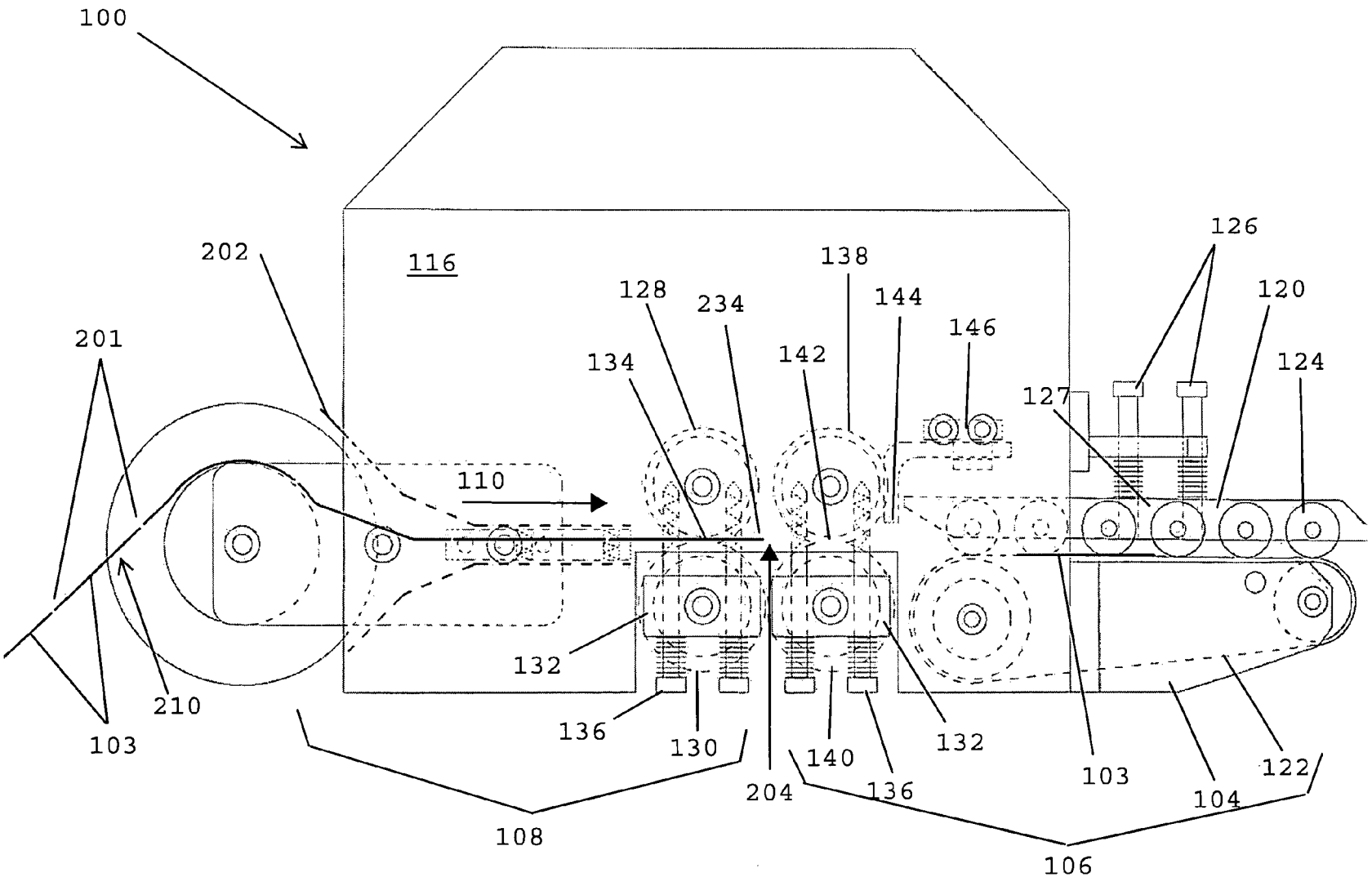
FIG. 5 is a side view of the insertion device of FIG. 1, with portions of an infeed and an outfeed shown in phantom.

Referring now to FIG. 5, inserter 100 is shown in a side view with some elements within housing 116 in phantom. Infeed 108 may include a driven roller 128 and an idler roller 130. A tensioning bar 132 may be provided to adjust the degree of contact and tension between the two rollers 128 and 130 at an infeed nip 134. Tensioning bar 132 may be provided with spring biased tensioning screws 136 which permit a relatively constant force to be exerted at infeed nip 134 while permitting some vertical movement for objects passing along path 110. A tension release may also be provided that permits selective displacement of tensioning bar 132 away from roller 128 so that contact between the two rollers of infeed 108 is broken. Thus, when inserter 100 is not in use, stress may be removed from components of the infeed to avoid excessive wear or temporary or permanent deformation of the rollers.

Outfeed 106 may include a driven roller 138 and an idler roller 140 defining an outfeed nip 142. Idler roller 140 may be removably and releasably held in place adjacent driven roller 138 with another tension bar 132 and spring biased tensioning screws 136. To permit rollers 128 and 138 to be mounted closely to each other, a position sensor 144 may be mounted downstream from rollers 138 and 140 and mounted to housing 116 by a sensor mount 146. Position sensor 144 may be mounted as close as possible to rollers 138 and 140 to detect the position of coupons 103 as the coupons advance along path 110.

Figure 6:
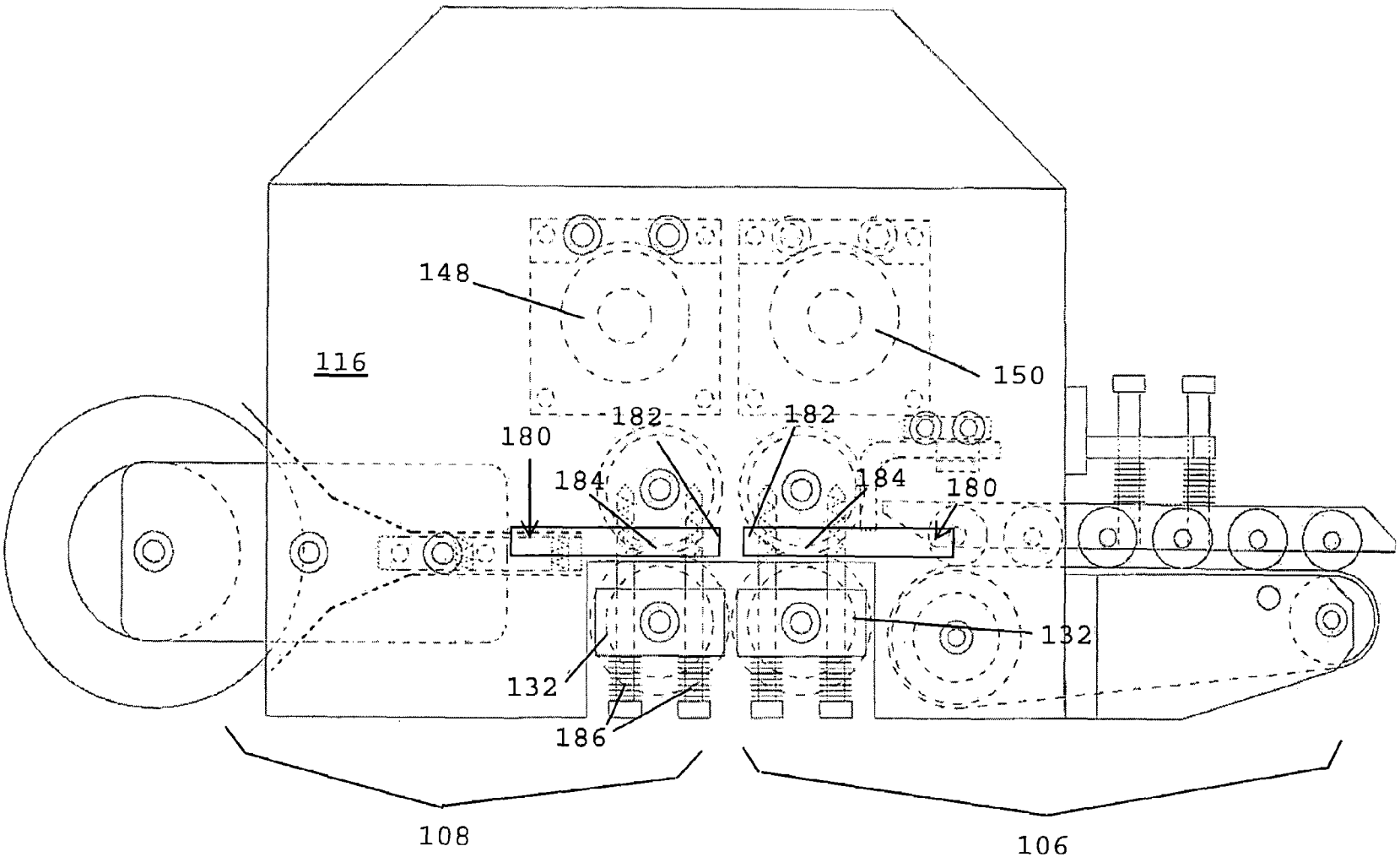
FIG. 6 is a side view of the inserter of FIG. 5 with servo motors for the infeed and outfeed shown in phantom.
Figure 7:
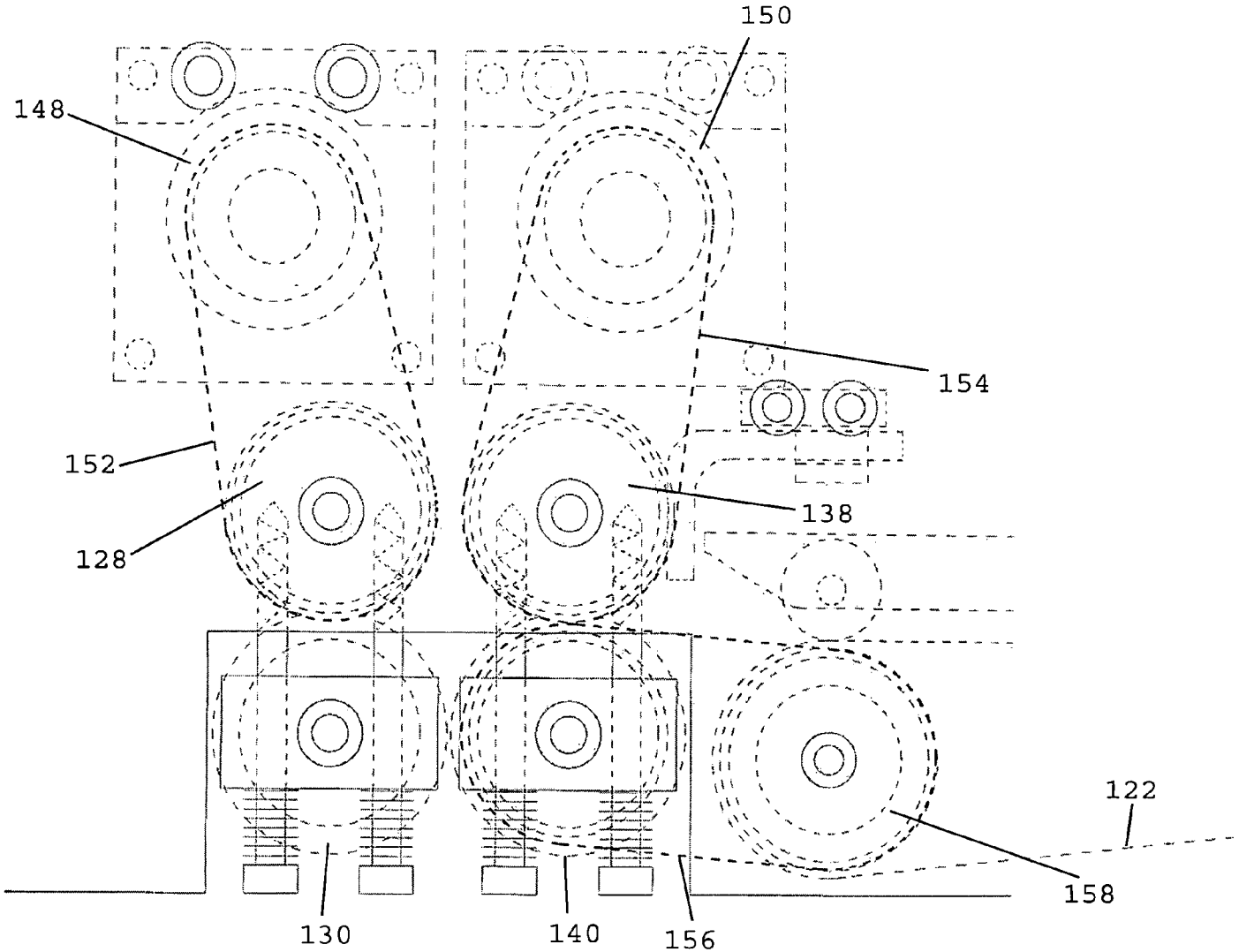
FIG. 7 is an enlarged side view of a portion of the inserter of FIG. 6, with drive belts shown in dashed lines operatively connecting the infeed and outfeed to the servo motors.

Referring now to FIGS. 6 and 7, a first servo motor 148 may be mounted within housing 116 adjacent to infeed 108 and a second servo motor 150 may be mounted within housing 116 adjacent outfeed 106. A first drive belt 152 may operatively connect first servo motor 148 with driven roller 128 of infeed 108. A second drive belt 154 may operatively connect second servo motor 150 with driven roller 138 of outfeed 106. The use of separate servo controlled motors to independently drive the infeed and the outfeed permits flexibility and precision in the operation of inserter 100. Preferably, belts 152 and 154 provide a relatively non-slip connection between the motors and the driven rollers so that movements of the motors are translated into movements of the infeed and outfeed in a very direct fashion. Such a non-slip linkage may be by a toothed, geared or splined belt, as shown. Alternatively, such a non-slip connection may be provided by a direct gear drive, a solid transmission or torque tube, or other suitable arrangement.

To provide coordination and timing between the movement of driven roller 138 and idler roller 140 and belt 122 of outfeed 108, a similar non-slip drive arrangement such as a drive belt 156 may be provided between idler roller 140 and a roller 158 about which belt 122 passes. The diameters of the portions of the various rollers about which the drive belts pass may be selected to ensure that the speed at which a coupon is moved through outfeed nip 142 generally matches the speed of movement of belt 122 which collects a burst coupon after it passes through outfeed nip 142.

As shown, the servo motors 148, 152 are mounted above the rollers of the infeed and the outfeed. However, based on the requirements to fit inserter 100 within a particular space and to configure inserter 100 to work with different assembly lines, housing 116 may be configured with the servo motors mounted beneath the infeed and outfeed. Such an arrangement might essentially invert the arrangement as shown in FIGS. 5 to 7 but would not alter the operation of the inserter as described herein. Note that this inversion of some compenents might not apply to each and every component. The position of one or both of the servo motors, the drive mechanisms linking the servo motors to the infeed and outfeed, and other related components may be changed but the arrangement of the elements of the infeed and the outfeed may preferably remain as shown in the FIGS. Different mounting arrangements of the servo motors and their operative connection to the infeed and outfeed are anticipated within the scope of the present disclosure.

Referring now to FIG. 5, inserter 100 illustrates the arrangement of path 110 defined through infeed 108, a bursting gap or space 204, and outfeed 106. A continuous feed 210 of objects 103 connected by webs 201 enters infeed 108 along path 110 through a guide 202. Referring now also to FIGS. 6 and 7, first servo motor 148 may be energized to drive roller 128 of infeed 108 to advance feed 210 through path 110. As the forwardmost object 103 advances across bursting space 204 and through outfeed nip 142, sensor 144 detects a leading edge 234 of the insert. Sensor 144 is connected to controller 102 and sends a signal to the controller when the leading edge 234 passes the sensor. Second servo motor 150 may be energized to outfeed 106 at approximately the same speed (for example, a designated feed speed) as infeed 108. Controller 102 may be programmed with the length of objects 103. Based on the length of object 103 and the position of objects 103 advancing along path 110, controller 102 can de-energize first servo motor 148 when the web 201 between the forwardmost object 103 and the next adjacent object 103 is within bursting space 204.

With the first servo motor 148 de-energized, the infeed rollers stop with the second forwardmost object 103 held at infeed nip 134. Second servo motor 150 continues to be energized, driving the rollers of outfeed 106. This places the particular web 201 that happens to be positioned within bursting gap under sufficient tension to break or separate the web, which had been holding the forwardmost coupon 103 to the second forwardmost coupon. Once the web separates, the now-freed forwardmost coupon 103 advances through outfeed nip 142 between rollers 138 and 140 of outfeed 106 and onto belt 122. Idlers 124 hold this separated coupon against belt 122 which advances the coupon through outfeed 106 to nose 104 where it is ejected from inserter 100.

Once first servo motor 148 of infeed 108 has been de-energized, it may be desirable to increase the speed of second servo motor 150 of outfeed 106 to speed up the ejection of the separated coupon from the inserter. However, it may not be desirable to have outfeed 106 operating at a widely different speed than infeed 108 while an unburst coupon 103 is being positioned for separation. Once the separated coupon 103 has been ejected from inserter 100, speed of second servo motor 150 may be decreased to coincide with the feed speed of first servo motor 148.

Note that speeds in servo motors 148 and 150, and thus of rollers 128 and 138, respectively, need not be matched, but merely coordinated. In normal operation, it may be desirable that the speed of the outfeed be matched to the feed speed of the infeed while an insert is being positioned for bursting. This ensures that the infeed and the outfeed are not tensioning the insert until a web is positioned within the bursting gap. For different lengths and surface characteristics of inserts, it may be desirable to have outfeed 106 operating at a speed greater than the feed speed of infeed 108. For certain inserts, such as for those equal in length to a spacing of the nips 134 and 142, it has been determined that the speed of outfeed 106 may be as much as sixty percent greater than the feed speed of infeed 108. For these inserts, as soon as, or shortly after, the leading edge enters outfeed nip 142, the web between the first two inserts has already entered the bursting gap. For inserts substantially longer than the spacing between the infeed and outfeed nips, it is desirable that the speed of the infeed and the speed of the outfeed be matched to each other so that the insert is not excessively tensioned until the forwardmost web has entered the bursting gap.

Once first servo motor 148 has been de-energized, the speed of outfeed 106 may be raised to a speed much greater than the feed speed or the related speed. Preferably, this speed increase comes after the web within the bursting gap has been separated. For example, a feed speed of infeed 108 may be five hundred inches per minute. The matching speed of outfeed 106 may be from five hundred inches per minute (or up to eight hundred inches per minute shorter coupons, as described above). Once the coupon is positioned for bursting, infeed 108 may be stopped, the web between the first two coupons burst and outfeed 106 may be accelerated to five thousand inches per minute or more, depending on the capabilities of servo motor 150 and outfeed 106, and the characteristics of the coupons or objects 103 being ejected from inserter 100. Sensor 144 may also be used to detect a trailing edge of the burst coupon being moved along the outfeed to be ejected and inserter 100 may wait for the passage of this trailing edge of the burst coupon before accelerating the outfeed to the greater ejection speed. Alternatively, the outfeed may be accelerated without the need for a trailing edge to be sensed by sensor 144.

Sensor 144 may also be used as a failsafe. Sometimes, webs may fail to separate or other failures may occur during the feed and bursting process. If the outfeed is being driven and a failure to separate has occurred, then no trailing edge will pass by the sensor. Either the continuous feed will be fed through the inserter and no break will indicate a trailing edge, or the coupon to have been burst will be stuck in the path and will not pass the sensor. Controller 102 may be configured so that if a trailing edge has not been sensed by sensor 144 within a set period of time, motors 148 and 150 may be de-energized.

In a preferred operation mode, inserter 100 will have servo motor 150 powering outfeed 106 continually at a selected speed. The forward edge 234 of forwardmost coupon 103 of feed 210 will be preferably positioned within bursting gap 204, as shown in FIG. 5. When it is desired to eject a coupon from inserter 100, controller 102 will energize first servo motor 148 to accelerate infeed 108 to advance the forwardmost coupon 103 into outfeed rollers 138 and 140. These outfeed rollers will already be moving at the selected speed associated or related with the feed speed.

Once the web 201 holding the forwardmost coupon is within bursting gap 204, the bursting and ejecting as described above takes place. Once the coupon 103 has been ejected from inserter 100, outfeed 106 is slowed down to the selected speed associated or related with the feed speed to await the next coupon advanced into rollers 138 and 140 by infeed 108.

While the foregoing description indicates sensor 144 is located directly adjacent to roller 138 of outfeed 106 within bursting space 204, it is anticipated that sensor 144 may be mounted in a variety of locations along path 110 of inserter 100 according to the present disclosure. For example, sensor 144 may be located at an entry into infeed 208 and sense the passage of a leading edge of an item to be inserted as it enters inserter 100. As long as the distance from the sensing point to the bursting space are known, the distance necessary to move the forwardmost object through the bursting space and position the appropriate web 201 within the bursting space can be calculated and the controller can operate the inserter appropriately. Sensor 144 may be mounted in almost any desired location along the path downstream from outfeed nip 142. The minimum limitation on the length of the objects to be inserted depends on the distance separating the nips 134 and 142. The objects 103 need to be long enough so that when the forwardmost object is captured at outfeed nip 142, only one web 201 is within bursting gap 204. With sensor 144 located downstream of rollers 138 and 140 as shown in FIGS. 5 to 7, the practical minimum length of objects to be burst and inserted by inserter 100 is approximately the distance between nips 134 and 142. Depending on the length of the object to be inserted, sensor 144 may also be located further downstream of the bursting space within the outfeed. Sensor 144 may not be located further downstream from the bursting space than the length of the object to be inserted.

Figure 8:
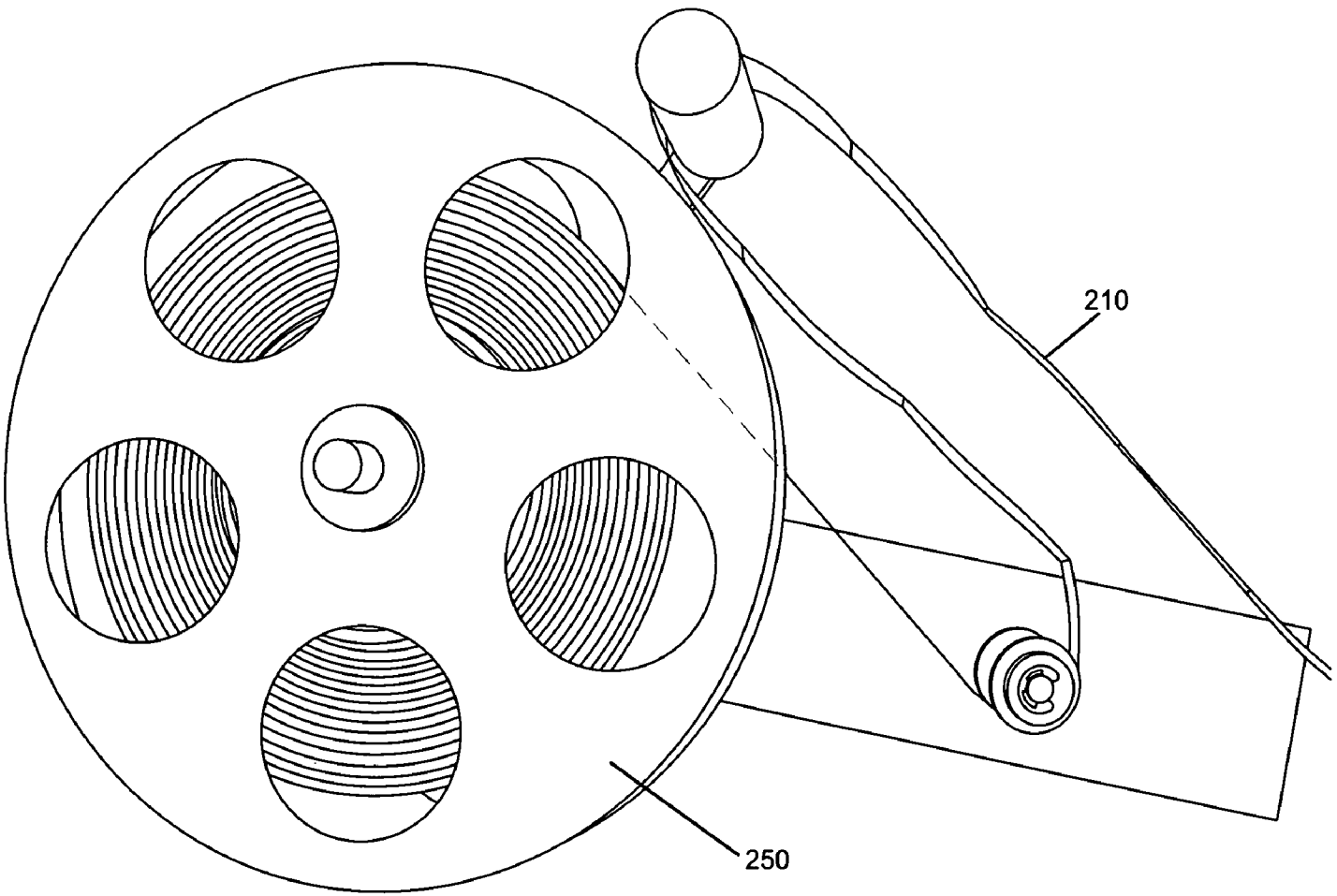
FIG. 8 is a supply reel of continuous feed inserts for use with the inserter according to the present disclosure.

It is desirable that rollers 128, 130, 138 and 140, as well as belt 122 be made of a material with a sufficient coefficient of friction with coupons 103 to ensure that the rollers and the belt adequately grip the coupons to maintain timing and function of inserter 100. As seen in FIG. 8, a roll 250 that may be mounted adjacent to inserter 100 to provide continuous feed 210 of objects 103 into infeed 108. Other feed arrangements are also anticipated within the scope of this disclosure, such as box feeds with fanfold arrangement of inserts, or other belt feed arrangements. Roll 250 is used as an illustrative example only.

It is anticipated that rollers 128, 130, 138 and 140 may be made of a resilient deformable material that will permit inserts of varying thickness to be handled by inserter 100 without adjustment. For example, continuous feed 210 may include inserts 103 of varying thickness, with some being comprised of a single layer of material, such as card stock, and others within the same feed being comprised of two or more layers of the same material. Or, inserts in the same continuous feed could comprise the same number of layers with the layers including materials of varying thicknesses. These deformable rollers may also work in conjunction with spring biased tension bars 132 to permit movement or downward displacement of rollers 130 and 140 in reaction to thicker inserts passing through path 110.

The rollers may develop temporary or permanent flat spots or depressions from being in constant contact under pressure with each other when inserter 100 is not in operation. A tension release may be provided to move tension bars 132 downward against springs and displace the rollers from each other when inserter 100 is not in operation. As shown in FIG. 6, a tension release lever 180 is provided adjacent each of the tension bars 132. By pivoting the release levers about an axis 184, an end 182 of each lever will engage an outer end of each tension bar 132 and force the tension bar against the spring bias of springs 186 and move the rollers out of contact with each other. Tension release levers may be mounted on both sides of inserter 100.

Figure 9:
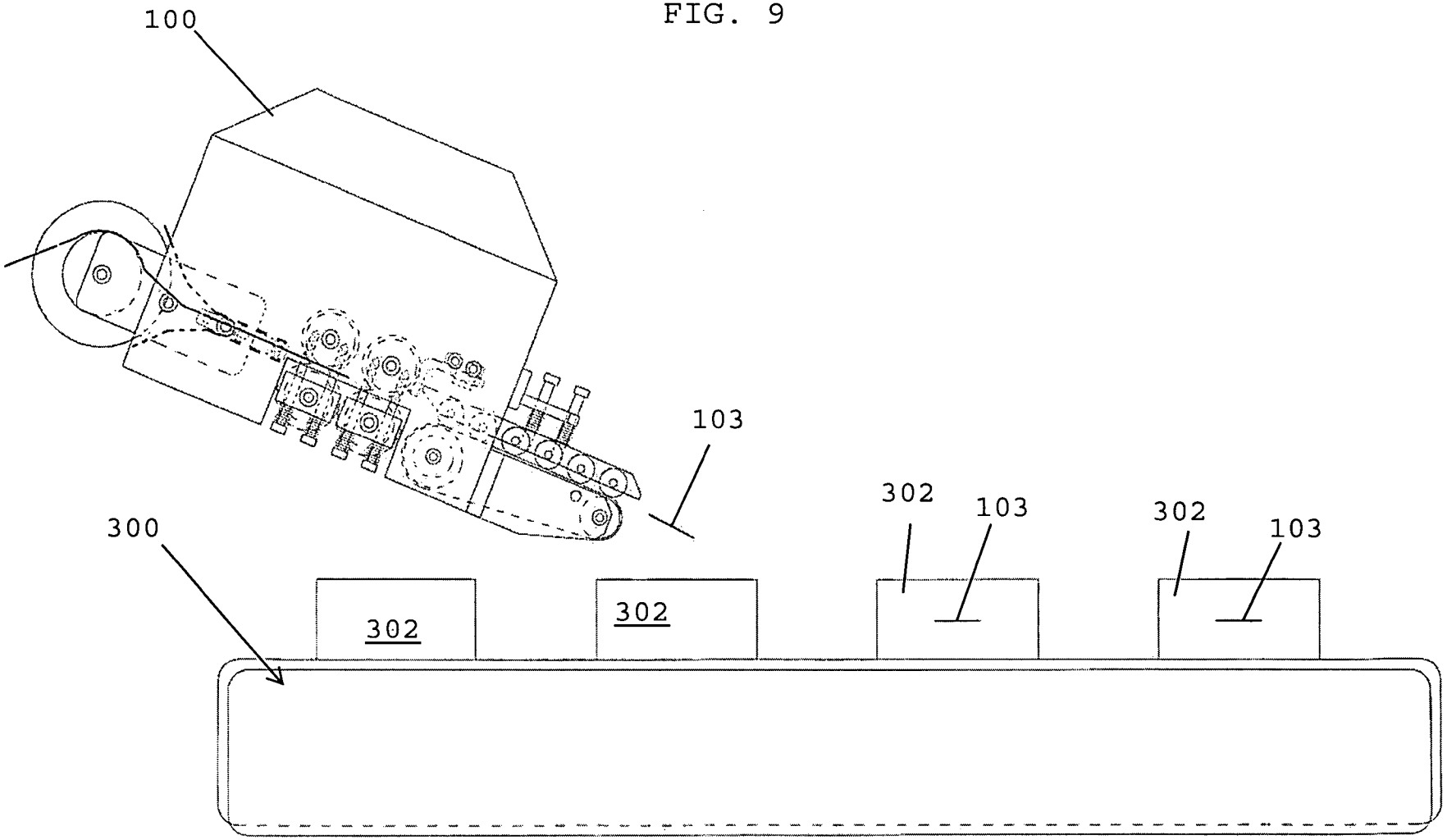
FIG. 9 is a side schematic view of a production line with an inserter according to the present disclosure mounted adjacent the production line and placing objects into items moving along the production line.

Referring now to FIG. 9, inserter 100 is positioned adjacent a production line 300 upon which a plurality of items 302 are advancing. When one of the items 302 is positioned to receive a coupon or other object from inserter 100, infeed 108 may be accelerated to move the forwardmost coupon or other object 103 through the bursting gap and into outfeed 106 so the that the web 201 holding the object 103 to feed 210 is within bursting gap 204. Infeed 108 is stopped, the forwardmost coupon is then burst from feed 210 and outfeed 106 ejects the object into the positioned item 302 of production line 300. Since it may be preferable for production line 300 to be in continual movement, a product sensor may be provided along the production line to indicate or determine when the next item 302 is moving toward inserter 100. Based on the speed of movement of production line 300 and the distance needed to advance, burst and eject the forwardmost object 103, controller 102 may energize first servo motor 148 before item 302 is positioned to receive the object 103, based on a signal received from the product sensor.

As a further alternative embodiment, an encoder may be incorporated into or positioned adjacent production line 300 to sense the speed of advance of products 302 along production line 300 toward inserter 100. If there is a variation in speed of production line 300, this may result in the particular item 302 not being positioned to receive the object 103 when the object is ejected from the inserter. Signals from the encoder could be received by controller 102 which could then vary the speed of outfeed 106 to take into account any changes in speed of the production line. If the line is stopped, the outfeed could also be stopped.

Inserters according to the present disclosure may not require a separate bursting device in the bursting space, as the ability to quickly accelerate and decelerate the servo motors and thus the infeed and outfeed relative to each other should provide sufficient tension to separate adjacent objects. However, it is anticipated that inserters including servo motors driving the infeed and outfeed may be adapted to include a bursting device if the nature of the objects, the web between objects or the continuous feed require additional bursting tension. Inserters including such bursting device are described in U.S. Pat. No. 7,032,774, issued on Apr. 25, 2006, the disclosure of which is incorporated herein by reference.

In the above description of operation, servo motor 148 driving infeed 108 is described as stopping movement between the various steps. However, it may also be that the inserter may be in continuous operation. This may be required by the speed of the production line and the number of items 302 needing an insert 103 that are moving along the production line 300. The bursting tension required in inserter 100 to separate web 201 between adjacent inserts 103 of feed 210, may be generated by having servo motor 148 continue to drive infeed 108 at the feed speed while servo motor 150 accelerates outfeed 106 to the higher insertion or ejection speed. Thus, the web between coupons may be tensioned and burst by the speed differential between the infeed and the outfeed, without having to stop infeed 108. The precision control provided by the use of servo motors and the use of non-slip drive arrangements between the servo motors and the belts, may permit rapid enough acceleration of the outfeed speed to create the necessary tension to burst the web, eject the now-burst forwardmost object 103 into the item and then rapid enough deceleration of the outfeed to match the feed speed before the next object 103 passes through the bursting space to engage the outfeed.

Figure 10:
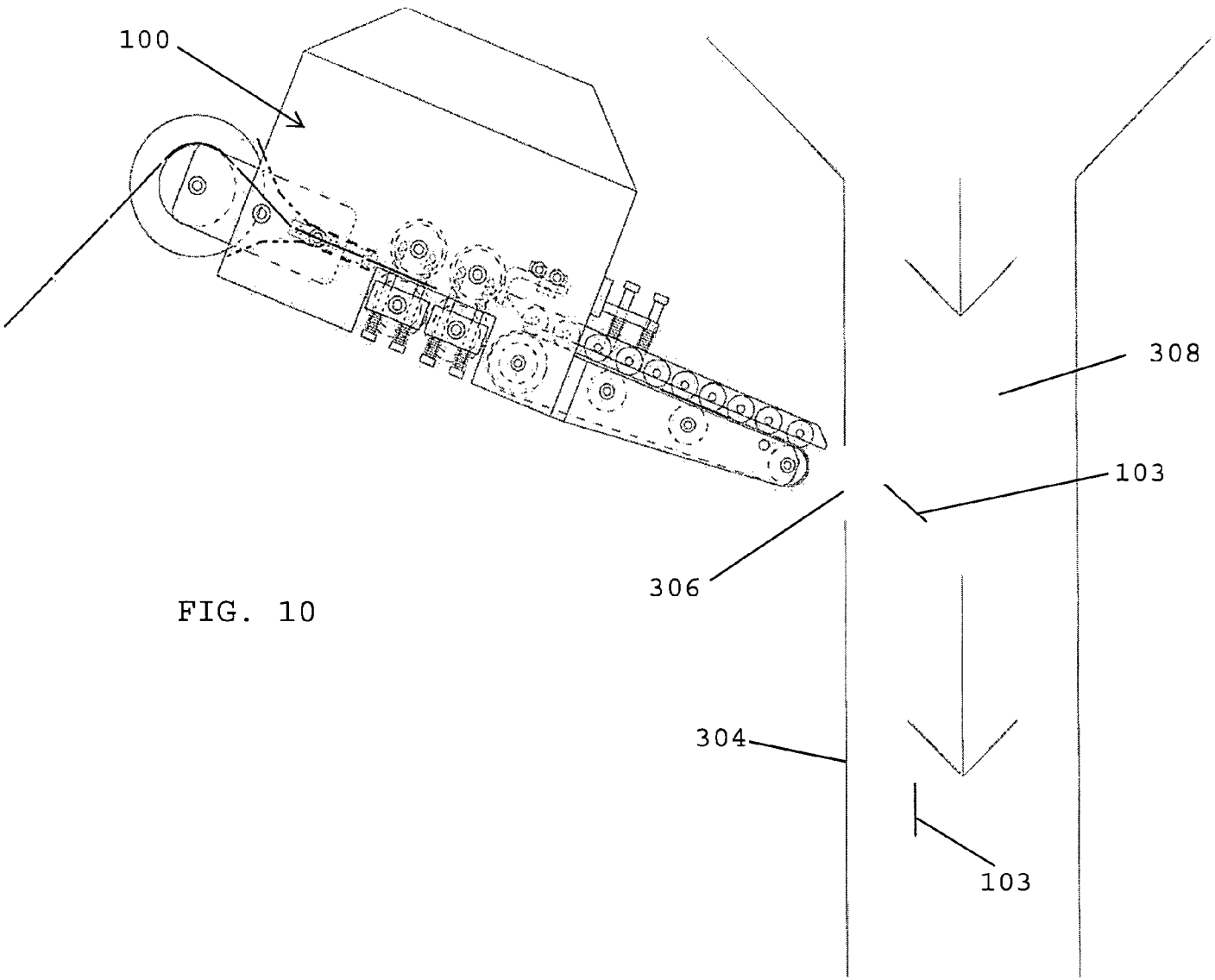
FIG. 10 is a side schematic view of an inserter according to the present disclosure mounted adjacent a drop chute for placing objects and product into items moving along a production line.

FIG. 10 illustrates a second embodiment of a production line element 304 with inserter 100 ejecting coupons 103 through an opening 306 into a drop chute 308. This sort of loading element for a production line might be used with loose materials or items such as chips, beans, pellets, etc, that are dropped into an item on a production line that includes a form-fill-seal packaging machine. In this element 304, it is desired to insert the coupon into the chute in time with the material dropping into the item on the production line. The signal to begin the process of separation of the forwardmost object 103 is originated in the form-fill-seal machine itself. This is distinct from the arrangement shown in FIG. 9, where the coupon is dropped directly into the item on the production line, with the process being commenced by the sensing of the approach of the production items 302. Otherwise, the operation and timing of ejection of coupons by inserter 100 in FIG. 10 is similar to the operation of inserter 100 adjacent production line 300 as shown in FIG. 9.

There may be practical limit to the length of the outfeed between bursting space 204 and nose 104 to permit this continuous operation. For inserter 100, a feed speed of approximately five hundred inches per second and an insertion speed approximately five thousand feet per second may permit extension of the nose of up to thirty-six inches or even further.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A method of inserting an insert into a package, the method comprising:

providing a bursting apparatus comprising an infeed powered by a first servo motor and an outfeed powered by a second servo motor, the infeed and outfeed cooperating to define a path for a continuous feed of connected inserts between a source of connected inserts and a point of delivery of an insert into the package, the path including a bursting space between the infeed and the outfeed;

energizing the second servo motor to drive the outfeed at a selected speed;

energizing the first servo motor to drive the infeed at a feed speed, wherein the speed of the outfeed is selected relative to the feed speed;

the infeed advancing a first insert of the connected inserts along the path until the first insert is positioned at least partially within the outfeed and a second insert of the connected inserts, adjacent the first insert, is positioned at least partially within the infeed, so that a first web connecting the first and second inserts is positioned in the bursting space;

with the web positioned in the bursting space, the infeed and outfeed supplying sufficient tension on the inserts to burst the web connecting the first and second inserts;

and, the outfeed advancing the burst first insert along the path and ejecting the first insert from the inserter, wherein the outfeed is accelerated from the selected speed to a higher speed after the insert is burst from the continuous feed and driven at this higher speed until the burst insert is ejected from the inserter, and once the burst insert is ejected from the inserter, the outfeed is decelerated to the selected speed;

when the first insert is ejected from the outfeed, energizing the servo motors to drive the infeed at the feed speed and the outfeed at the selected speed to position a second web between the second insert and a third insert, adjacent the second insert, within the bursting space, with the second insert at least partially within the outfeed and the third insert at least partially within the infeed.

2. The method of claim 1, further comprising, providing a controller which is operatively connected to the first and second servo motors, the controller configured to signal to the servo motors to alter the speed at which the servo motors drive the infeed and the outfeed, respectively.

3. The method of claim 2, further comprising:

operatively connecting a position sensor to the controller, and configuring the position sensor to sense the passage of a leading edge of an insert along the path and to send electronic signals to the controller;

programming the controller with the length of each insert;

generating a signal from the sensor when the leading edge of the first insert passes the sensor and sending the signal to the controller;

determining when the web between the first and second inserts is within the bursting space based on when the signal from the sensor is received and the length of the insert.

4. The method of claim 3 further comprising, after the web between the first and second inserts has been burst, determining when the first insert has been ejected from the outfeed based on when the web is burst, the length of the insert and the speed at which the second servo motor is driving the outfeed, and, after the first insert has been ejected, lowering the speed at which the second servo motor is driving the outfeed to the selected speed.

5. The method of claim 2, further comprising:

connecting a position sensor to the controller, and configuring and positioning the position sensor to sense the passage of a leading edge of an insert along the path and to send electronic signals to the controller;

programming the controller with the length of each insert;

receiving a signal at the controller from the sensor when the leading edge of the first insert passes the sensor;

determining when the web between the first and second inserts is within the bursting space based on the feed speed, the length of the insert and the signal received from the sensor.

6. The method of claim 1, further comprising stopping the infeed when the first web between the first and second inserts is positioned within the bursting space; and after the burst insert is ejected from the outfeed, accelerating the infeed to the feed speed to position the web between the second insert and the third insert within the bursting gap.

7. A method of inserting an insert into a package, the method comprising:

providing a bursting apparatus comprising an infeed powered by a first servo motor and an outfeed powered by a second servo motor, the infeed and outfeed cooperating to define a path for a continuous feed of connected inserts between a source of connected inserts and a point of delivery of an insert into the package, the path including a bursting space between the infeed and the outfeed;

using the first servo motor to drive the infeed at a feed speed and the second servo motor to drive the outfeed at a selected speed related to the feed speed, so that a first insert of the connected inserts is positioned at least partially within the outfeed and a second insert of the connected inserts, adjacent the first insert, is positioned at least partially within the infeed, so that a web connecting the first and second inserts is positioned in the bursting space;

with the web positioned in the bursting space, tensioning and bursting the web between the first insert from the second insert to separate the first insert from the second insert;

after the first insert is separated from the second insert, using the second servo motor to accelerate the outfeed to an ejection speed to propel the first insert toward the point of delivery and eject the first insert from the outfeed;

when the first insert is ejected from the outfeed, decelerating the outfeed to the selected speed and driving the infeed at the feed speed to position a web between the second insert and a third insert, adjacent the second insert, within the bursting space, with the second insert at least partially within the outfeed and the third insert at least partially within the infeed.

8. The method of claim 7 wherein the first insert is separated from the second insert by stopping the infeed and driving the outfeed at the selected speed.

9. The method of claim 7, wherein the first insert is separated from the second insert with the infeed being driven at a slower speed than the outfeed.

10. An inserter for inserting an object into an item on a production line, the inserter comprising:

a continuous feed of objects, with a plurality of objects linearly arranged with a web between each adjacent object;

an infeed comprising an infeed driven roller operatively connected to a first servo motor and an infeed idler roller in contact with the infeed driven roller;

an outfeed comprising an outfeed driven roller operatively connected to a second servo motor and an outfeed idler roller in contact with the outfeed driven roller, and an outfeed belt extending from the outfeed rollers to a point of ejection from the inserter, the outfeed belt operatively connected to the second servo motor;

a bursting gap defined between the rollers of the infeed and the rollers of the outfeed;

a path defined in the inserter for the continuous feed to pass through the rollers of the infeed, then through the bursting gap, then through the outfeed rollers and then along the outfeed belt to the point of ejection;

wherein the outfeed belt is located entirely between the outfeed rollers and the point of ejection;

a controller operatively connected with each of the servo motors;

wherein the controller energizes the first servo motor to advance a forwardmost object of the continuous feed at a feed speed through the infeed rollers into the bursting gap and to the outfeed rollers, and energizes the second servo motor at a speed related to the feed speed to move the forwardmost object partially into the outfeed with the web between the forward most object and the next object within the bursting gap;

wherein the controller drives the second servo motor to place enough tension on the continuous feed to break the web within the bursting gap and burst the forwardmost object and the next object from each other; and, wherein the outfeed belt advances the burst forwardmost object along the path and ejects the burst forwardmost object from the inserter;

wherein after the forwardmost object has been burst, the second servo motor drives the outfeed belt at a speed higher than the speed related to the feed speed; and, wherein after the object has been ejected from the inserter, the higher speed of the outfeed is decelerated to the speed related to the feed speed.

11. The inserter of claim 10, wherein after the burst forwardmost object has been ejected from the inserter and the outfeed has been decelerated to the speed related to the feed speed, the first servo motor drives the infeed to advance the next object of the continuous feed through the bursting gap and into the outfeed and position the next object for bursting from the continuous feed.

12. The inserter of claim 10, wherein after burst forwardmost object has been ejected from the inserter, the first servo motor drives the infeed to advance the next object of the contionous feed through the busting gap and into the outfeed and position the next object for bursting from the continous feed.

13. The inserter of claim 10, wherein the inserter is positioned adjacent a production line and the speed of the outfeed after the forward most object has been burst is dependent on the speed of items moving along the production line.

* * * * *